US006575060B1

(12) United States Patent
Tseng et al.

(10) Patent No.: US 6,575,060 B1
(45) Date of Patent: Jun. 10, 2003

(54) REVERSIBLE RATCHET WRENCH

(75) Inventors: Yi Chuan Tseng, Taichung Hsien (TW); Wan Chuan Lee, Taichung Hsien (TW)

(73) Assignee: AWI Acquisition Company, Sylmar, CA (US)

( * ) Notice: Subject to any disclaimer, the term of this patent is extended or adjusted under 35 U.S.C. 154(b) by 0 days.

(21) Appl. No.: 10/255,047

(22) Filed: Sep. 24, 2002

Related U.S. Application Data

(63) Continuation-in-part of application No. 10/100,798, filed on Mar. 18, 2002.

(51) Int. Cl.[7] ..... B25B 13/46

(52) U.S. Cl. ..... 81/63.2; 81/60; 81/61; 81/62; 81/63.1

(58) Field of Search ..... 81/60, 61, 62, 81/63.1, 63.2

(56) References Cited

U.S. PATENT DOCUMENTS 4,528,873 A * 7/1985 Lee ..... 81/57.29
4,561,329 A * 12/1985 Lack ..... 81/62
6,260,448 B1 * 7/2001 Chaconas ..... 81/63
6,435,062 B1 * 8/2002 McCann ..... 81/63
6,460,431 B1 * 10/2002 Chen ..... 81/63.2
6,467,378 B1 * 10/2002 Chen ..... 81/60

* cited by examiner

*Primary Examiner*—Lee D. Wilson
*Assistant Examiner*—Alvin J Grant
(74) *Attorney, Agent, or Firm*—Jack C Munro

(57) ABSTRACT

A reversible ratchet wrench which uses a pawl that can be moved between a right position and a left position. The pawl is in continuous connection with a rotatable ratchet wheel. The ratchet wheel rotates freely in a clockwise direction when the pawl is in the right position and is fixed to the wrench body when in the left position. The ratchet wheel rotates freely in a counterclockwise direction when the pawl is in the left position and is fixed to the wrench body when in the right position. A drive plate is mounted on the panel and is connected to a mechanism which is manually moved to cause the pawl to move.

6 Claims, 4 Drawing Sheets

REVERSIBLE RATCHET WRENCH

REFERENCE TO PRIOR APPLICATION

This application is a continuation-in-part of U.S. patent application Ser. No. 10/100,798, filed Mar. 18, 2002 entitled RATCHET WRENCH HAVING A SWITCH MECHANISM by the present inventors.

BACKGROUND OF THE INVENTION

1. Field of the Invention

The present invention relates to ratchet wrenches and more particularly to a ratchet wrench that can reverse its direction of operation.

2. Description of the Related Art

Ratchet wrenches have long been known. A typical ratchet wrench comprises an elongated body which terminates in a head. The head usually includes either a socket or a socket pin. The socket and the socket pin is to be used to apply torque to a fastener to tighten and loosen that fastener.

Typically, ratchet wrenches utilize a small pawl which is pivoted to different positions relative to a ratchet wheel. With the pawl in one position, the ratchet wheel will permit the tool to be used to tighten a fastener in a clockwise direction and then slip if the tool is turned in a counterclockwise direction. With the pawl in the other position, the reverse is to occur.

One of the problems associated with prior art type of ratchet wrenches is that the mechanism that is used to produce the movement of the pawl is subject to wear, and after a period of time, the mechanism will actually wear out resulting in the ratchet wrench becoming in operative. It would be desirable to avoid this replacement of ratchet wrenches and permit the construction of a wrench which is not readily subject to being worn out.

SUMMARY OF THE INVENTION

The basic embodiment of the present invention takes the form of a ratchet wrench which is constructed of an elongated body which terminates at one end in a head. Within the head is formed a through opening. A ratchet mechanism is mounted on the head and connects with the through opening. The ratchet mechanism comprises a ratchet wheel mounted in the through opening. The ratchet wheel is rotatable in both a clockwise and counterclockwise direction. A torque applier is connected to the ratchet wheel. The torque applier is for applying a turning force to an exterior object. The ratchet wheel has a series of gear teeth. A pawl is mounted on the head with the pawl having an engagement means which is to engagingly connect with the series of gear teeth. The pawl is movable between a first position and a second position. With the pawl in the first position, the ratchet wheel is not rotatable in the clockwise direction and is rotatable only in the counterclockwise direction. With the pawl in the second position, the ratchet wheel is not rotatable in the counterclockwise direction but is rotatable in the clockwise direction. A drive plate is attached to the pawl and protrudes from the pawl. A switching mechanism is mounted on the head with the switching mechanism connecting with the drive plate. The switching mechanism is movable between a right position and a left position. Locating of the switching mechanism in the right position locates the pawl in the first position and locating of the switching mechanism in the left position locates the pawl in the second position.

A further embodiment of the present invention is where the basic embodiment is modified by the through opening formed within the ratchet wheel being of a non-circular configuration.

A further embodiment of the present invention is where the basic embodiment is modified by the torque applier comprising a socket pin.

A further embodiment of the present invention is where the basic embodiment is modified by the series of gear teeth being formed on the exterior surface of the ratchet wheel.

A further embodiment of the present invention is where the basic embodiment is modified by there being a connector engaging with the drive plate and the connector has an internal chamber with the drive plate extending into this internal chamber.

A further embodiment of the present invention is where the just previous embodiment is modified by there being formed a thin slit within the body of the connector and it is through this slit that the drive plate extends.

A further embodiment of the present invention is where the just previous embodiment is modified by the connector being formed of sheet material in the shape of a box.

A further embodiment of the present invention is where the basic embodiment is modified by the switching mechanism being manually operable.

A further embodiment of the present invention is where the basic embodiment is modified by the switching mechanism being defined as including a cavity with this cavity being adapted to receive the connector where the connector is movable with the switching mechanism.

A further embodiment of the present invention is where the basic embodiment is modified by the switching mechanism including a spring assembly which engages with the drive plate for causing movement of the switching mechanism between the right position and the left position.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figures 1, 2:
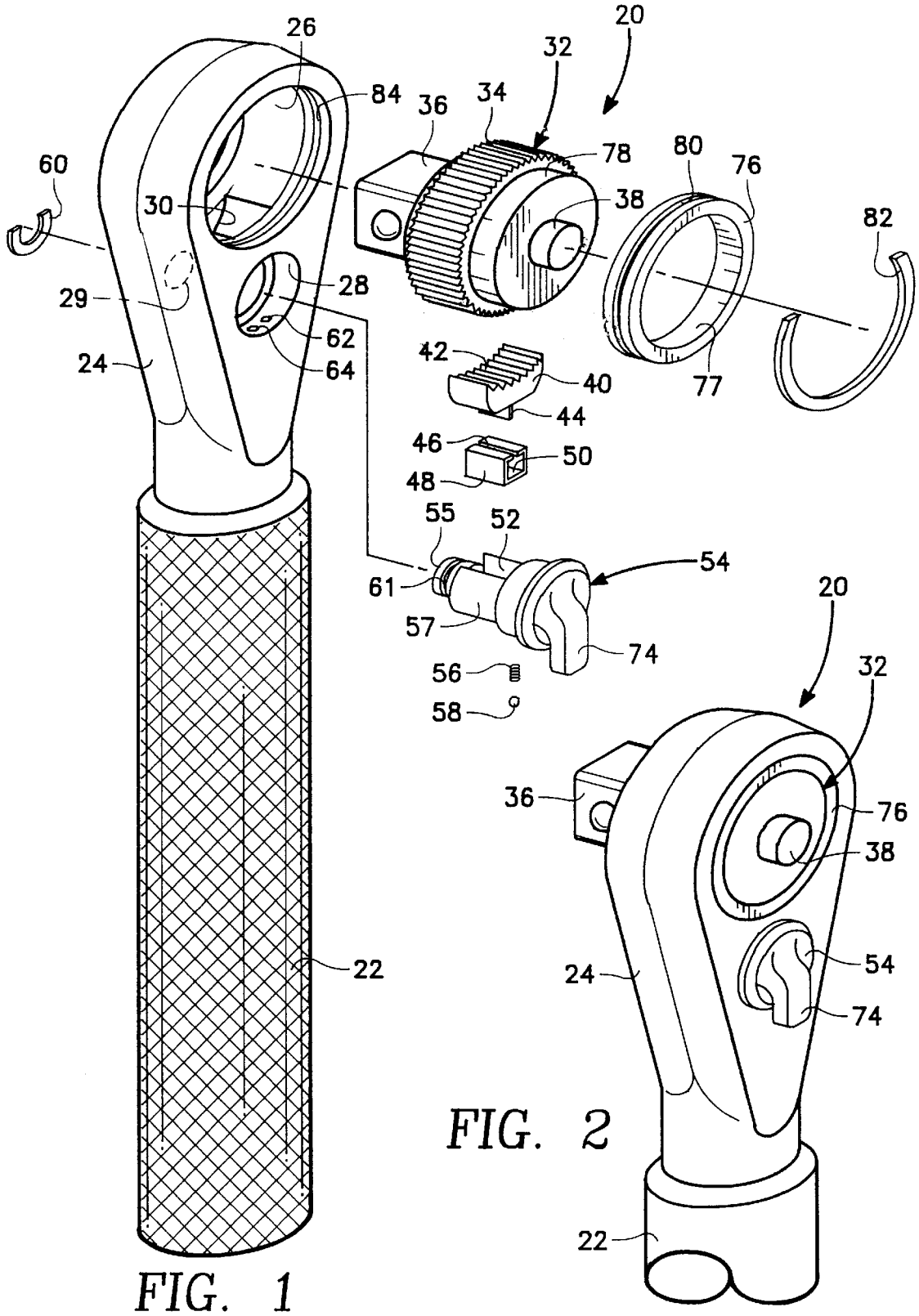
FIG. 1 is an exploded (unassembled) isometric view of a first embodiment of ratchet wrench constructed in accordance with the present invention which uses a socket pin as a torque applier.
FIG. 2 is an isometric view of the head portion of the ratchet wrench of FIG. 1 in the assembled state.

Referring particularly to the drawings, there is shown in FIGS. 1–5 the first embodiment 20 of reversible ratchet wrench of this invention. The first embodiment 20 has an elongated body 22. The body 22 is shown cylindrical. However, it is not necessary that the body 22 be cylindrical. For example, the body could be octagonal in shape. The body 22 could also be thin and flat with the lower end of the body being connected to some structure, such as an open end wrench. The upper end of the body 22 is connected to a head 24. Formed within the head 24 is a through opening 26. The through opening 26 is cylindrical. There is also a smaller in diameter through opening 28 formed within the head 24. Internally within the head 24 the through opening 28 connects with the through opening 26 by a connecting passage 30. Aligned with through opening 28 is an exit opening 29.

A ratchet wheel 32 is mounted within the through opening 26 and is capable of rotational movement there within. The exterior surface of the ratchet wheel 32 forms a continuous series of gear teeth 34. Fixedly mounted onto the ratchet wheel 32 is a torque applier commonly referred to as a socket pin 36. The ratchet wheel 32 is mounted about a center shaft 38. The socket pin 36 is to facilitate connection to an exterior structure that has a recess within which is to be located in a close conforming manner the socket pin 36. The socket pin 36 is to be used to affect applying torque to the exterior structure by the engagement of the recess and the socket pin 36. Such application of torque is well known. A common form of exterior structure what is commonly referred to as sockets that can be utilized to affect turning of a fastener.

Figure 4:
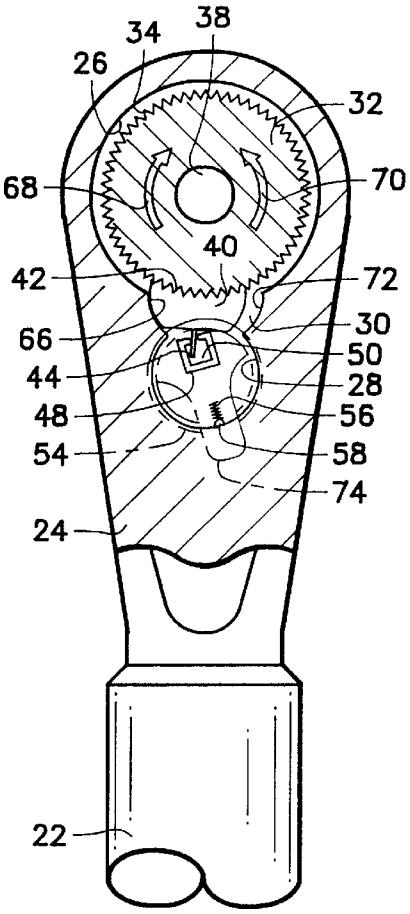
FIG. 4 is a transverse cross-sectional view taken along line 4-4 of FIG. 3 showing the pawl engaging with the ratchet wheel in a first position.
Figure 3:
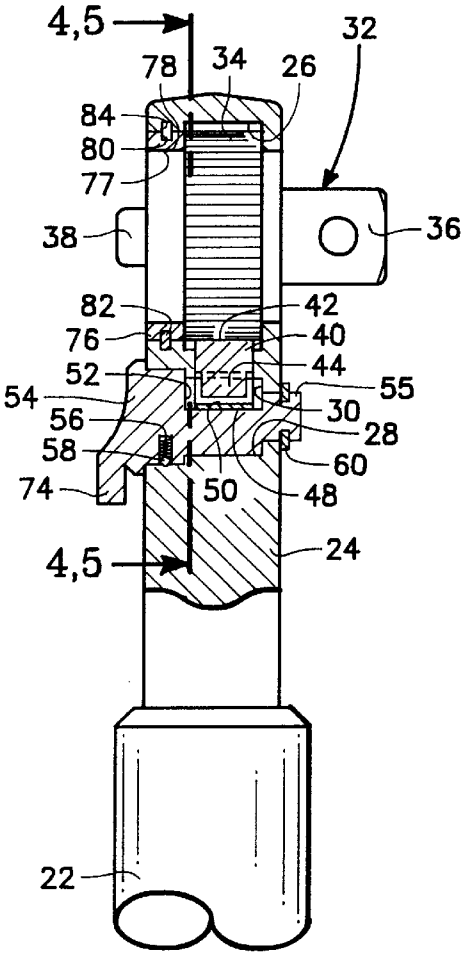
FIG. 3 is a longitudinal cross-sectional view through the assembled ratchet wrench of FIG. 2.

Mounted within the connecting passage 30 is a pawl 40. Pawl 40 has an upper arcuate surface that includes a plurality of gear teeth 42. Fixedly mounted onto the back side of the pawl 40 is a drive plate 44. Drive plate 44 is to extend through slit 46 of a connector 48. Connector 48 is formed of sheet material which in transverse is of square configuration. Connector 48 will generally be no more than one-quarter to one-half inch in length. Connector 48 has an internal chamber 50. Connector 48 is to be locatable within a cavity 52 of a switch housing 54. The switch housing 54 has mounted therein a coil spring 56 which connects with a ball 58. The switch housing 54 is mounted within through opening 28 and is securely held in position by means of a snap ring 60. Snap ring 60 rides within groove 61 formed within smaller diametered cylindrical extension 55 which is integral to cylindrical body 57 of switch housing 54. Extension 55 is located in exit opening 29 and extends exteriorly of head 24. When in position, the ball 58 is capable of riding within indent 62 or indent 64. If the ball 58 is located within indent 62, the angular position of the switch housing 54 is such that the drive plate 44 is moved to the left, as is shown in FIG. 4. In this position, the left edge of the pawl 40 abuts against wall surface 66 of the connecting passage 30. If a turning torque is applied to the elongated body 22 in the direction of arrow 68 as is shown in FIG. 4, rotational movement of the ratchet wheel 32 is prevented. This is because the ratchet wheel 32 is locked to the pawl 40 which is pressed against the wall surface 66. However, if the torque is applied in the direction of arrow 70, the pawl 40 will turn with the elongated body 22 and slippage will occur between gear teeth 34 and 42. This slippage produces a chattering action with is termed ratcheting. The pawl 40 will actually deflect slightly as it rides over the gear teeth 34. This ratcheting action occurs because the right side of the pawl 40 is spaced from the wall surface 72 of the connecting passage 30.

Figure 5:
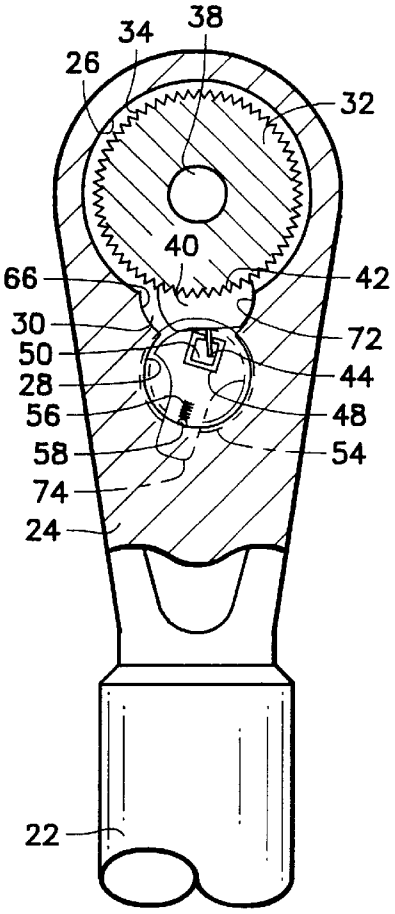
FIG. 5 is a longitudinal cross-sectional view taken along line 5-5 of FIG. 3 which is similar to FIG. 4 but showing the pawl engaging with the ratchet wheel in a second position.

When the switch housing 54 is manually turned by handle 74 clockwise about twenty-five to thirty degrees to the position shown in FIG. 5, the drive plate 44 cants at a different angle which is permitted by the internal chamber 50 of the connector 48. Also, the pawl 40 is relocated to the right, as is readily apparent when comparing FIG. 4 to FIG. 5 with the result that the pawl 40 will abut against wall surface 72 of the connecting passage 30. In this position, the ball 58 now connects with indent 64. When torque is applied to the elongated handle 22 in the direction of arrow 70, the socket pin 36 is carried with the elongated body 22 with the result that a torque will be applied through the socket pin 36 to an exterior structure. This direction is counterclockwise. Movement of the elongated body in the clockwise position as represented by arrow 68 will result in the pawl 40 deflecting permitting slippage to occur between the gear teeth 34 and 42 because the pawl 40 is spaced from wall surface 66. Again, there is a ratcheting movement created.

Although not shown, there could be an indent located between indent 62 and indent 64, and when the ball 58 was located within that indent, the pawl 40 would be spaced from both wall surfaces 60 and 72. This would permit a slipping ratcheting action to occur in both directions 68 and 70.

Ratchet wheel 32 is held in position by a ring 76 which has an internal annular surface 77 which is mounted about annular shoulder 78 of the ratchet wheel 32. The exterior surface of the ring 76 has an annular groove 80. A snap ring 82 is to be mounted within the annular groove 80 with this snap ring 82 being also mounted within an annular groove 84 formed within the wall surface of the through opening 26. The snap ring 82, in cooperation with the ring 76, functions to maintain the mounted position of the ratchet wheel 32 within the through opening 26.

Figure 6:
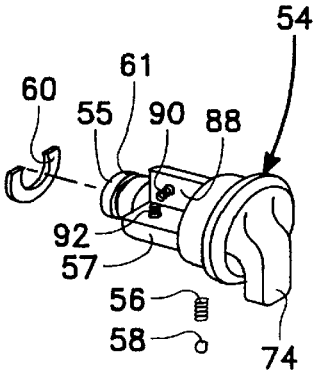
FIG. 6 is an isometric view of a second embodiment of switching mechanism that is utilized in conjunction with the ratchet wrench of the present invention.
Figure 7:
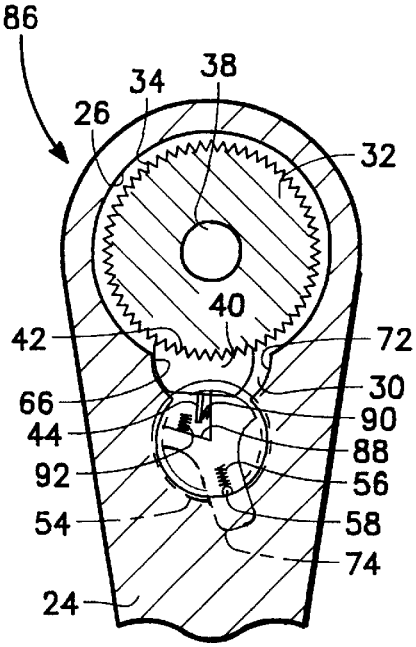
FIG. 7 is a view similar to FIG. 4 but where the second embodiment of switching mechanism of FIG. 6 is used.
Figure 8:
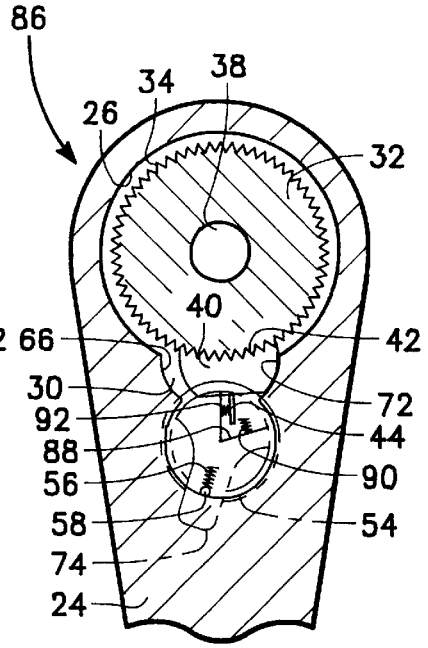
FIG. 8 is a view similar to FIG. 5 but with the second embodiment of switching mechanism of FIG. 6 being used.

Referring particularly to the second embodiment 86 of this invention which shown in FIGS. 6–8 of the drawings, like numerals have been utilized to refer to like parts. However, instead of the drive plate 44 being mounted in conjunction with the connector 40, cylindrical body 57 of the switch housing 54 is formed with a right angled cutout 88. Within one wall surface of the right angle cutout 88 is located a small coil spring 90. A similar coil spring 92 is mounted within the other wall surface of the right angle cutout 88. Each of the coil springs 90 and 92 are capable of coming into contact with the drive plate 44. Therefore, when the switch housing 54 is pivoted clockwise, as is shown in FIG. 7, the coil spring 90 will apply pressure against the drive plate 44 and move the pawl 40 against the wall surface 66. This is the same position as was previously described in reference to FIG. 4. If the switch housing 54 is now moved clockwise about twenty-five to thirty degrees, the coil spring 90 will be located spaced from the drive plate 44 and the coil spring 92 will then come into contact with the drive plate 44 and function to move the pawl 40 against wall surface 72. This is the equivalent position to FIG. 5. The advantage to the structure shown in FIGS. 6–8 is that the connector 48 has been eliminated and, in essence, the structural arrangement simplified.

Figure 9:
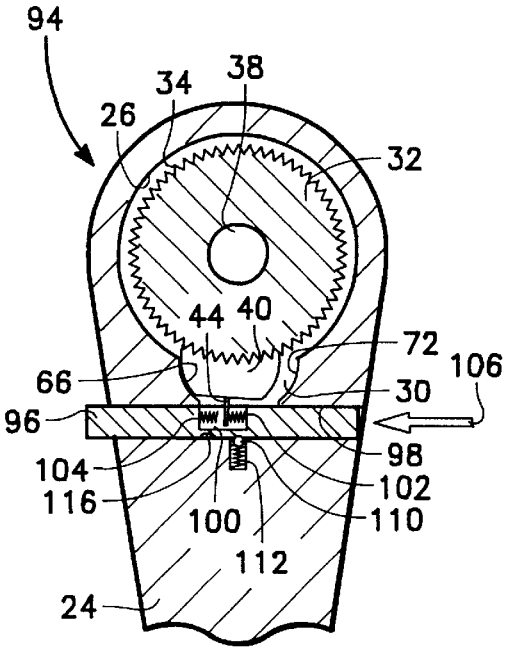
FIG. 9 is a cross-sectional view similar to FIG. 4 but of a third embodiment of switching mechanism showing the switching mechanism in a first position.
Figure 10:
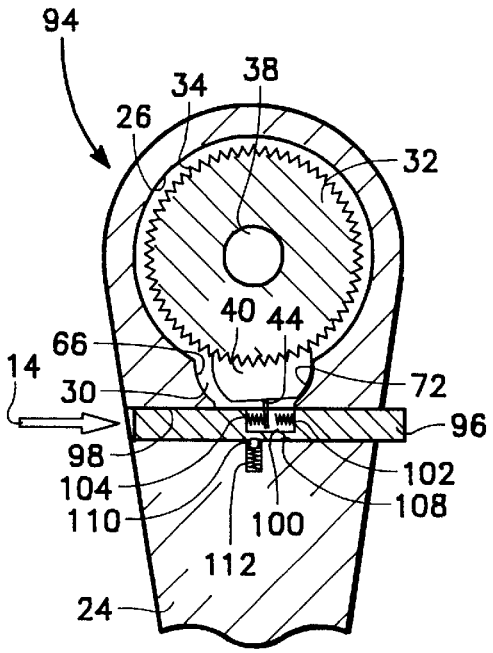
FIG. 10 is a view similar to FIG. 9 but showing the second embodiment switching mechanism in a second position.

Referring particularly to FIGS. 9 and 10 there is shown the third embodiment 94 of this invention. Again, like numerals have been utilized to refer to like parts. In the third embodiment 94, the pivotable switch housing 54 has been eliminated and instead there is substituted a lineally movable slider 96 which is slidable within through hole 98. The slider 96 includes a centrally located cavity 100. The drive plate 44 is to be located within the cavity 100. On one sidewall of the cavity 100 is located a coil spring 102. A similar coil spring 104 is mounted on the opposite sidewall of the cavity 100. The drive plate 44 is located between the coil springs 102 and 104.

With the slider 96 being moved in the direction of arrow 106 within the through hole 98 of the head 24, the coil spring 102 will apply pressure against the drive plate 44 and move the pawl 40 against wall surface 66. This is again similar to FIG. 4. Usage of the wrench of FIG. 9 will be in the same manner as the wrench was used in FIG. 4. There is an indent 108 that is formed within the slider 96 that connects with a ball 110 which is spring biased outwardly by a coil spring 112. The ball 110 will slip within the indent 108 which will tend to hold the slider 96 in this position and prevent accidental movement of the slider 96 when the wrench is being used when in the position of FIG. 9.

When a manual force is applied in the direction of arrow 114 to the slider 96 to cause the slider to be moved to the right, as shown in FIG. 10 with coil spring 104 coming into contact with the drive plate 44 and cause the pawl 40 to be moved against wall surface 72, the ball 100 would be disengaged from the indent 108 and will ride within indent 116 also formed within the slider 96. This indent 116 will tend to retain the position of the slider 96 and prevent such from being accidentally moved so that the wrench can be used when in the position of FIG. 10.

Figure 11:
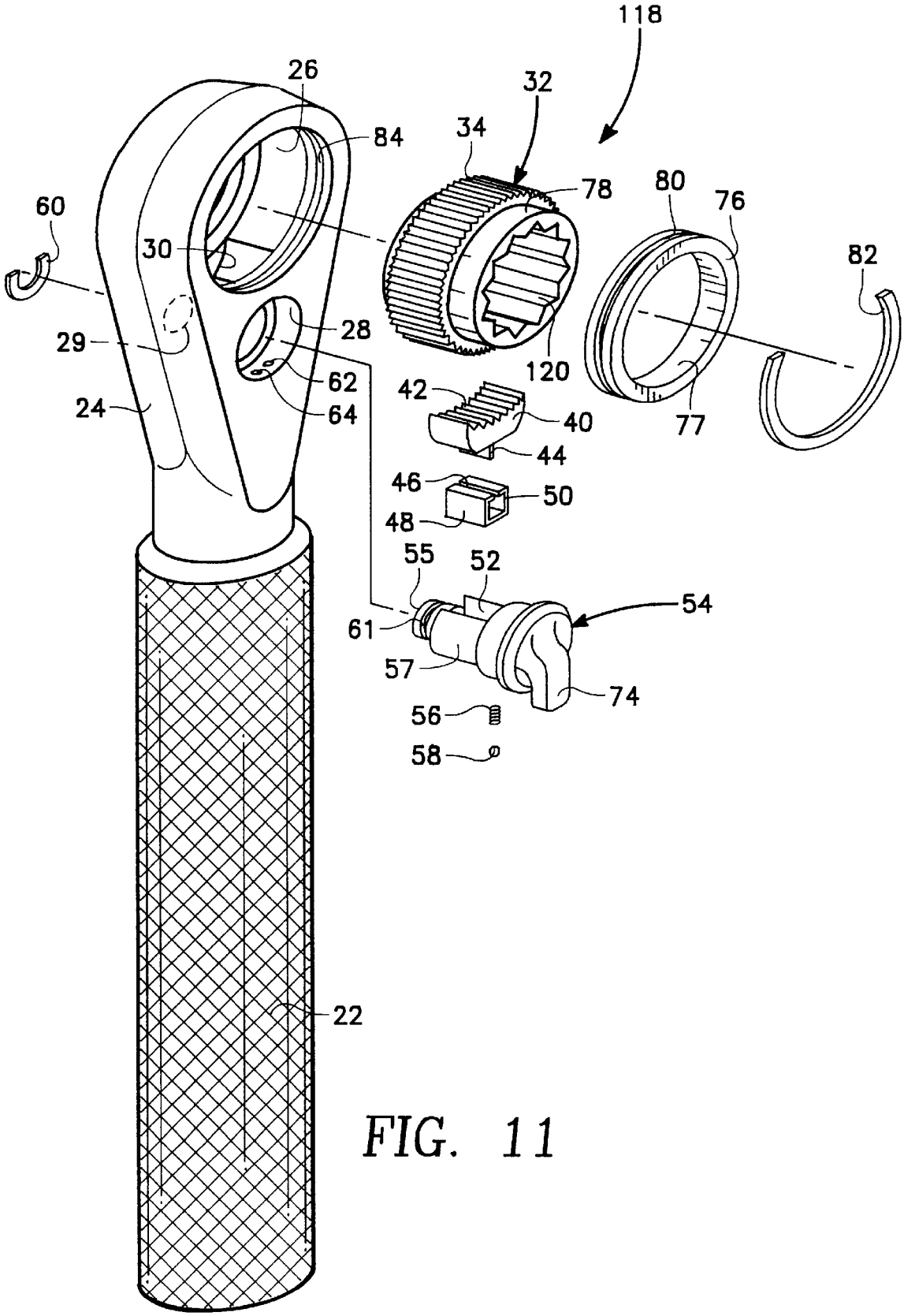
FIG. 11 is an exploded isometric view of a fourth embodiment of this invention which is similar to FIG. 1 except that a socket is used as the torque applier.

Referring particularly to FIG. 11, there is shown a fourth embodiment 118 of this invention, with again like numbers being used to refer to like parts. The only difference of the structure in FIG. 11 when compared to FIG. 1 is that the socket pin 36 is eliminated with a non-circular hole 120 being formed within the interior of the ratchet wheel 32. Typically, the non-circular hole 120 will have a series of longitudinal grooves formed within the wall surface of the hole 120. These longitudinal grooves can be defined as serrations with these serrations to connect with a hexagonal head of a fastener, which is not shown. Therefore, a turning movement can be applied to the fourth embodiment 118 which will result in appropriate turning of this hexagonal headed fastener, which is again not shown.

What is claimed is:

1. A reversible ratchet wrench comprising:

an elongated body which terminates at one end in a head, said head having a through opening, a ratchet mechanism mounted on said head and connecting with said through opening, said ratchet mechanism comprising:

a ratchet wheel mounted in said through opening, said ratchet wheel being rotatable in both a clockwise and a counterclockwise direction, a torque applier connected to said ratchet wheel, said torque applier for applying a turning force to an exterior object, said ratchet wheel having a series of gear teeth;

a pawl mounted on said head, said pawl having engagement means which is to engagingly connect with said series of gear teeth, said pawl being movable between a first position and a second position, with said pawl in said first position said ratchet wheel being not rotatable in said clockwise direction and being only rotatable in said counterclockwise direction, with said pawl in said second position said ratchet wheel being not rotatable in said counterclockwise direction and being only rotatable in said clockwise direction;

a drive plate attached to said pawl and protruding from said pawl;

a switching mechanism mounted on said head, said switching mechanism connecting with said drive plate, said switching mechanism being movable between a right position and a left position, locating of said switching mechanism in said right position locates said pawl in said first position, locating said switching mechanism in said left position locates said pawl in said second position; and a connector includes a non-circular center opening.

2. A reversible ratchet wrench comprising:

an elongated body which terminates at one end in a head, said head having a through opening, a ratchet mechanism mounted on said head and connecting with said through opening, said ratchet mechanism comprising:

a ratchet wheel mounted in said through opening, said ratchet wheel being rotatable in both a clockwise and a counterclockwise direction, a torque applier connected to said ratchet wheel, said torque applier for applying a turning force to an exterior object, said ratchet wheel having a series of gear teeth;

a pawl mounted on said head, said pawl having engagement means which is to engagingly connect with said series of gear teeth, said pawl being movable between a first position and a second position, with said pawl in said first position said ratchet wheel being not rotatable in said clockwise direction and being only rotatable in said counterclockwise direction, with said pawl in said second position said ratchet wheel being not rotatable in said counterclockwise direction and being only rotatable in said clockwise direction;

a drive plate attached to said pawl and protruding from said pawl;

a switching mechanism mounted on said head, said switching mechanism connecting with said drive plate, said switching mechanism being movable between a right position and a left position, locating of said switching mechanism in said right position locates said pawl in said first position, locating said switching mechanism in said left position locates said pawl in said second position; and a connector engages with said drive plate, said connector having an internal chamber, said drive plate protruding into said internal chamber.

3. A reversible ratchet wrench comprising:

an elongated body which terminates at one end in a head, said head having a through opening, a ratchet mechanism mounted on said head and connecting with said through opening, said ratchet mechanism comprising:

a ratchet wheel mounted in said through opening, said ratchet wheel being rotatable in both a clockwise and a counterclockwise direction, a torque applier connected to said ratchet wheel, said torque applier for applying a turning force to an exterior object, said ratchet wheel having a series of gear teeth;

a pawl mounted on said head, said pawl having engagement means which is to engagingly connect with said series of gear teeth, said pawl being movable between a first position and a second position, with said pawl in said first position said ratchet wheel being not rotatable in said clockwise direction and being only rotatable in said counterclockwise direction, with said pawl in said second position said ratchet wheel being not rotatable in said counterclockwise direction and being only rotatable in said clockwise direction;

a drive plate attached to said pawl and protruding from said pawl;

a switching mechanism mounted on said head, said switching mechanism connecting with said drive plate, said switching mechanism being movable between a right position and a left position, locating of said switching mechanism in said right position locates said pawl in said first position, locating said switching mechanism in said left position locates said pawl in said second position;

a connector engages with said drive plate, said connector having an internal chamber, said drive plate protruding into said internal chamber; and said connector has a slit through its wall surface, said drive plate passing through said slit.

4. The reversible ratchet wrench as defined in claim 3 wherein:

said connector is in the shape of a box with said connector being constructed of sheet material.

5. The reversible ratchet wrench as defined in claim 4 wherein:

said switching mechanism includes a cavity, said cavity to receive said connector with said connector being movable with said switching mechanism.

6. A reversible ratchet wrench comprising:

an elongated body which terminates at one end in a head, said head having a through opening, a ratchet mechanism mounted on said head and connecting with said through opening, said ratchet mechanism comprising:

a ratchet wheel mounted in said through opening, said ratchet wheel being rotatable in both a clockwise and a counterclockwise direction, a torque applier connected to said ratchet wheel, said torque applier for applying a turning force to an exterior object, said ratchet wheel having a series of gear teeth;

a pawl mounted on said head, said pawl having engagement means which is to engagingly connect with said series of gear teeth, said pawl being movable between a first position and a second position, with said pawl in said first position said ratchet wheel being not rotatable in said clockwise direction and being only rotatable in said counterclockwise direction, with said pawl in said second position said ratchet wheel being not rotatable in said counterclockwise direction and being only rotatable in said clockwise direction;

a drive plate attached to said pawl and protruding from said pawl;

a switching mechanism mounted on said head, said switching mechanism connecting with said drive plate, said switching mechanism being movable between a right position and a left position, locating of said switching mechanism in said right position locates said pawl in said first position, locating said switching mechanism in said left position locates said pawl in said second position; and said switching mechanism includes a spring assembly, said spring assembly comprises a pair of springs each of which engages with said drive plate, said spring assembly for causing movement of said switching mechanism between said right position and said left position by causing deflection of said drive plate which results in movement of said pawl between said first position and said second position.

* * * * *